United States Patent [19]

Tomaszewski

[11] 4,167,460

[45] Sep. 11, 1979

[54] TRIVALENT CHROMIUM PLATING BATH COMPOSITION AND PROCESS

[75] Inventor: Thaddeus W. Tomaszewski, Dearborn, Mich.

[73] Assignee: Oxy Metal Industries Corporation, Warren, Mich.

[21] Appl. No.: 892,581

[22] Filed: Apr. 3, 1978

[51] Int. Cl.[2] ..... C25D 3/06

[52] U.S. Cl. ..... 204/51; 204/43 R

[58] Field of Search ..... 204/51, 43 R, 105 R, 204/123; 148/6.16

[56] References Cited

U.S. PATENT DOCUMENTS 3,084,111 4/1963 Strauss et al. ..... 204/51

4,054,494 10/1977 Gyllenspetz et al. ..... 204/43 T

*Primary Examiner*—G. L. Kaplan

*Attorney, Agent, or Firm*—Richard P. Mueller; Arthur E. Kluegel

[57] ABSTRACT

An aqueous acidic trivalent chromium electroplating solution and process for depositing chromium platings employing a bath containing trivalent chromium, a complexing agent, a reducing agent and a controlled effective amount of an anionic or nonionic surface active agent selected from the class of organic mono- or di- or tri-ester phosphates which contributes to improve operating characteristics and efficiency of the electroplating bath and enhances the uniformity of the chromium deposit.

12 Claims, No Drawings

TRIVALENT CHROMIUM PLATING BATH COMPOSITION AND PROCESS

BACKGROUND OF THE INVENTION

Ecological considerations have in recent years spurred increased interest and development of trivalent chromium electroplating solutions as an alternative for the conventional hexavalent chromium plating solutions of the types heretofore known and in widespread commercial use. In addition to the comparatively low toxicity of such trivalent chromium plating baths in comparison to the conventional hexavalent chromium solutions, trivalent plating baths also overcome certain inherent disadvantages of the hexavalent chromium plating baths including their limited covering power and sensitivity to current interruptions during an electroplating cycle. However, a number of problems have arisen in the attempt to commercially adapt trivalent chromium solutions to commercial operation which has detracted from their widespread commercial acceptance and adoption.

Among the several problems associated with trivalent electroplating solutions has been the attainment of an adequate chromium deposit in low current density areas of workpieces and the sensitivity of the solution to the presence of hexavalent chromium which adversely effects its plating rate and the thickness of the deposit produced. In addition, trivalent chromium plating solutions of the types heretofore known have also been sensitive to concentration of trivalent chromium present in the bath with respect to the plating coverage obtained necessitating careful monitoring and control of chromium concentration to maintain uniformity in the thickness of plating deposit on successive workpieces processed.

The trivalent chromium electroplating bath and the process of producing chromium deposits in accordance with the present invention overcomes many of the problems and the disadvantages associated with prior art compositions and techniques providing for an increase in the operating parameters of the plating bath whereby greater fluctuations in the concentrations of the bath constituents can be tolerated while nevertheless producing substantially uniform and successively repetitive plating deposits on workpieces even in the low current density areas thereof.

SUMMARY OF THE INVENTION

The benefits and advantages of the present invention in accordance with its composition aspects are based on the discovery that by incorporating a controlled but effective amount of an anionic or nonionic surface active agent selected from the class of organic mono- or di- or tri-ester phosphates in conventional aqueous acidic trivalent chromium plating solutions provides for a surprising increase in chromium coverage in low current density recessed areas while also substantially increasing the tolerance of the bath to higher concentrations of hexavalent chromium. The incorporation of the surface active agent also provides for substantially constant chromium coverage and chromium plate thicknesses over relatively broad ranges of trivalent chromium concentration.

The electroplating bath in other respects is conventional for trivalent chromium solutions incorporating as its essential constituent trivalent chromium in an amount of from about 0.2 to about 0.6 molar trivalent chromium, a complexing agent such as formate ion in an amount of from about 0.2 to about 1.8 molar to provide a ratio of formate to chromium of about 1:1 up to about 3:1, a reducing agent in an amount to maintain the hexavalent chromium content in the plating solution at a level below about 6 parts per million (ppm) and optionally, but preferably, conventional concentrations of conductivity salts including ammonium ions and a buffering agent to maintain the bath composition within a pH range of from about 2.5 up to about 4.

In accordance with the process aspects of the present invention, substantially uniform chromium platings are deposited on workpieces employing the trivalent chromium electroplating solution as hereinabove described utilizing current densities ranging from about 50 up to about 250 ASF at a bath temperature ranging from about 15° C. to about 35° C. The workpieces, prior to electroplating, are subjected to a conventional cleaning and pretreatment and thereafter are immersed in the plating solution while cathodically charged for time periods of from about 30 seconds up to about 5 minutes or longer to deposit the chromium plating in the desired plate thickness.

Additional benefits and advantages of the present invention will become apparent upon a reading of the description of the preferred embodiments taken in conjunction with the specific examples provided.

DESCRIPTION OF THE PREFERRED EMBODIMENTS

The trivalent aqueous acidic electroplating solution in accordance with the present invention contains as an essential constituent trivalent chromium which is conveniently introduced in the form of an aqueous soluble chromium salt of which chromium chloride usually in the hexahydrate form or chromium sulfate or chromium fluoride constitute the preferred materials generally for economic considerations. These chromium salts are readily water soluble and are employed in amounts so as to provide a molar concentration of trivalent chromium in the final bath within a range of from about 0.2 to about 0.6 molar. In addition to the trivalent chromium constituent, the bath further contains a complexing agent for the trivalent chromium of any of the types known in the art. Preferably the complexing agent comprises the formate and/or acetate ion which is introduced in the form of a simple salt such as ammonium formate or ammonium acetate or an alkali metal formate such as sodium or potassium formate, for example, and are employed in amounts to provide a molar ratio of formate to chromium of about 1:1 up to about 3:1. When sodium formate is employed it is generally present in a range of from about 32 to 96 g/l, and preferably 60 g/l, while if potassium formate is used, the broad range is 38 to 115 g/l, and the preferred amount is 70 g/l.

In addition to the chromium and complexing constituents, the bath further contains as an essential constituent a reducing agent for reducing any hexavalent chromium formed during the operation of the bath. Any one of the variety of reducing agents known in the art can be employed for this purpose including for example bromides, hypophosphites, aldehydes, such as formaldehyde and glyoxal, for example, bisulfites, aldehyde metal bisulfites such as sodium formaldehyde bisulfite, sodium formaldehyde sulfoxylate or the like. Regardless of the specific type of reducing agent employed, the quantity is accurately controlled so as to maintain the hexavalent chromium concentration in the bath at a level below that at which these might occur detrimental effects to the plating deposits as a result of hexavalent chromium concentration. In the case of bromides, for example, concentrations may range from about 0.01 up to about 4 molar with concentrations preferably ranging less than 1 molar and more usually from about 0.05 to about 0.3 molar. When hypophosphites are employed, their concentration will typically range from about 0.5 molar up to about 2.0 molar depending on the concentration of trivalent chromium. The hypophosphites are conveniently introduced in the form of simple alkali metal salts such as sodium hypophosphite monohydrate. Aldehyde and aldehyde bisulfite reducing agents are typically employed in concentrations ranging from about 1 up to about 10 g/l dependent on the concentration of hexavalent chromium present in the bath.

In addition to the foregoing essential constituents, the bath may optionally further contain any one or a mixture of so-called conductivity salts to increase bath conductivity, which generally comprise simple salts of strong acids such as sulfuric acid and hydrochloric acid. Particularly satisfactory conductivity salts are the alkali metal salts of hydrochloric and sulfuric acids such as sodium chloride and sodium sulfate. Additionally, ammonium chloride and ammonium sulfate can be advantageously employed to introduce ammonium ions in the bath which serve a secondary complexing function as well as enhancing bath conductivity. These conductivity salts of the types well known in the art are employed in conventional amounts usually up to about 300 g/l.

The bath further contains a hydrogen ion concentration to provide an operating pH of from about 2.5 up to about 4.0, while pH's of about 2.8 to about 3.4 are preferred. The pH range can be maintained by appropriate addition of ammonium, sodium or potassium hydroxide since the bath tends to become progressively acidic during use. The use of ammonium hydroxide also effects a replenishment of the ammonium ions in the bath lost as a result of drag-out. Maintenance of appropriate pH is substantially facilitated by the use of a buffering agent of which boric acid and borate salts constitute the preferred materials. Such buffering agents are usually employed in concentrations ranging from about 0.5 molar up to about 1.0 molar.

It is further contemplated that the bath may contain other dissolved metals such as iron, cobalt, nickel, manganese, tungsten or the like in concentrations of from 0 up to saturation when it is desired to deposit platings comprising a chromium alloy.

In accordance with the present invention, the foregoing trivalent chromium plating bath incorporating the essential constituents along with any of the optional constituents further includes as an essential component an anionic or nonionic surface active agent which is selected from the class of organic mono- or di- or triester phosphates, whereby the improved operating characteristics and plating deposits are attained. The surface active agent can generally be employed in concentrations as low as about 0.01 g/l to amounts up to about 1.5 g/l. Concentrations below about 0.02 g/l are undesirable since the full benefits attainable at higher concentrations cannot be achieved at such low concentrations. On the other hand, concentrations in excess of about 1.5 g/l are undesirable for economic considerations in that they do not produce any appreciable benefits over those obtainable at concentrations below about 1.5 g/l. Particularly satisfactory results are obtained when the surface active agent is employed in concentrations ranging from about 0.05 go about 0.2 g/l.

The anionic or nonionic surface active agent is selected from the class comprising mono- or di- or triester phosphates in accordance with the structural formula as hereinafter set forth:

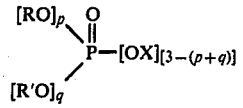

Wherein:

R′=an alkyl group of 8 carbons;

X=H, Na or K;

p=1 or 2; pl q=0 or 1;

(p+q)=2 or 3;

R=R″—$OCH_2CH_2$—$_n$ in which;

R″=R‴—aryl, an alkyl group having 1 to 10 carbons, or H;

R‴=an alkyl group having 1 to 10 carbons or H; and n=0–12

A nonionic surface active agent of the foregoing class which has been found to be particularly satisfactory is one available from DuPont under the brand name "Zonyl A" and another from Witco Chemical Company under the trade name "Emphos" and which both comprised a modified polyethylene glycol type compound in which in accordance with the foregoing structural formula p=2; q=1; R=$HOCH_2CH_2$—; n=1; and R′=$CH_3(CH_2)_7$—.

In accordance with the process aspects of the present invention, a trivalent aqueous acidic electroplating solution is prepared incorporating the constituents as hereinabove set forth in appropriate concentrations. The electroplating bath can be operated within a temperature ranging from about 15° C. up to 35° C. while temperatures of from about 20° C. to about 25° C. are usually preferred. The electroplating operation can be carried out at current densities ranging from about 50 up to about 250 amperes per square foot while current densities of about 75 to about 125 ASF are preferred. The workpieces prior to electroplating are subjected to conventional pretreatments in accordance with prior art practices and the electroplating process is particularly effective for depositing chromium platings on articles which have been previously subjected to a nickel plating operation.

During operation of the electroplating bath, a maintenance of the appropriate pH is preferably achieved by employing ammonium, sodium or potassium hydroxide since the bath has a tendency to become more acidic during use. The use of ammonium hydroxide for pH control also simultaneously effects a replenishment of the ammonium ion which is lost by evaporation and drag out. The remaining bath constituents are conventionally replenished to maintain appropriate concentrations employing dry solids.

In operation, the workpieces to be plated are cathodically charged and the bath incorporates a suitable anode of a material which will not adversely effect the solution composition and which is compatible therewith. For this purpose, anodes of an inert material such as carbon are preferred, although other inert anodes of platinized titanium can also be employed. When a chromium-iron alloy is to be deposited, the anode may suitably be comprised of iron which itself will serve as the source of iron ions in the bath.

In order to further illustrate the composition and method of the present invention, the following specific examples are provided. It will be understood that the examples are provided for illustrative purposes and are not intended to be limiting of the scope of the invention as herein disclosed and as set forth in the subjoined claims.

EXAMPLE 1

A trivalent chromium electroplating solution is prepared by dissolving the following constituents in water to produce an aqueous acidic solution of the following composition:

| Constituent | Concentration |
|---|---|
| Chromium chloride hexahydrate | 0.4 molar |
| Ammonium formate | 0.84 molar |
| Sodium formaldehyde bisulfite | 4–6 g/l |
| Potassium chloride | 75 g/l |
| Surfactant* | 0.2 g/l |
| Boric acid | 40 g/l |

*Zonyl A

The bath is agitated by bubbling air therethrough or by mechanical agitation and is operated at a pH of from about 2.5 to about 3.6. The temperature of the bath ranges from 20° C. to 25° C. and at a current density of from 100 to 150 ASF. Satisfactory uniform chromium platings are obtained.

EXAMPLE 2

A trivalent chromium electroplating bath is prepared by dissolving bath constituents in the concentrations as hereinafter set forth:

| Constituent | Concentration |
|---|---|
| Chromium chloride hexahydrate | 0.4 molar |
| Ammonium formate | 0.84 molar |
| Ammonium bromide | 10 g/l |
| Ammonium chloride | 90 g/l |
| Potassium chloride | 75 g/l |
| Surfactant* | 0.2 g/l |
| Boric acid | 40 g/l |

*Zonyl A

The electroplating solution is operated at a pH of about 2.5 to about 3.6 and at a temperature of from 20° C. to 25° C. Articles are electroplated during agitation of the bath at a current density of from 100 to 150 ASF and satisfactory uniform chromium platings are obtained.

EXAMPLE 3

An aqueous acidic trivalent chromium electroplating solution is prepared employing the constituents in the concentrations as follows:

| Constituent | Concentration |
|---|---|
| Chromium chloride hexahydrate | 100 g/l |
| Ammonium formate (50% soln.) | 80 ml/l |
| Sodium formaldehyde bisulfite | 4–6 g/l |
| Ammonium chloride | 90 g/l |
| Potassium chloride | 75 g/l |
| Surfactant* | 0.2 g/l |
| Boric acid | 40 g/l |

*Zonyl A

The bath is mechanically agitated by stirring and operates at a pH ranging from 2.5 to 3.5 at a temperature of about 20° C. to about 25° C. At a current density of 100 ASF, the bath produces about an 80 mm plating coverage on a Hull cell panel. The plating bath operates satisfactorily when the surfactant concentration is varied within a range of from 20 up to 600 mg/l.

EXAMPLE 4

An electroplating solution is prepared incorporating the constituents and the concentrations as set forth below:

| Constituent | Concentration |
|---|---|
| Chromium sulfate | 125 g/l |
| Sodium formaldehyde bisulfite | 5 g/l |
| Ammonium formate (50% soln.) | 80 ml/l |
| Ammonium chloride | 90 g/l |
| Potassium chloride | 75 g/l |
| Surfactant* | 0.2 g/l |
| Boric acid | 40 g/l |

*Zonyl A

The bath has an operating pH of about 2.5 to 3.5 and is mechanically agitated. At a current density of 100 ASF and a temperature of about 20° C. to 25° C., a chromium plating of about 80 mm is obtained on a Hull cell panel. The bath operates satisfactorily when the surfactant is employed over a broad concentration range of 20 up to 600 mg/l.

EXAMPLE 5

A trivalent chromium electroplating solution is prepared employing the following constituents in the following concentrations:

| Constituent | Concentration |
|---|---|
| Chromium chloride hexahydrate | 106 g/l |
| Ammonium formate | 55 g/l |
| Sodium formaldehyde bisulfite | 4–6 g/l |
| Ammonium chloride | 90 g/l |
| Potassium chloride | 75 g/l |
| Surfactant* | 1.5 g/l |
| Boric acid | 40 g/l |

*Zonyl A

The plating bath is operated at a temperature ranging from 20° C. up to 26° C. at a pH of 2.5 up to 4.5. At a current density of 100 to 150 ASF employing air or mechanical agitation, satisfactory chromium platings are deposited.

EXAMPLE 6

An aqueous acidic trivalent chromium electroplating solution is prepared employing the constituents in the concentrations as set forth below:

| Constituent | Concentration |
|---|---|
| Chromium chloride hexahydrate | 106 g/l |
| Ammonium formate | 55 g/l |
| Ammonium bromide | 10 g/l |
| Ammonium chloride | 90 g/l |

-continued

| Constituent | Concentration |
|---|---|
| Potassium chloride | 75 g/l |
| Surfactant* | 1.5 g/l |
| Boric acid | 'g/l |

*Zonyl A

The plating bath operates at a pH of 2.5 up to 4.5 at a temperature of about 20° C. to 26° C. and at a current density of about 100 to 150 ASF. Satisfactory uniform chromium platings are produced.

EXAMPLE 7

An aqueous acidic trivalent chromium electroplating solution is prepared employing the constituents in the concentrations as follows:

| Constituent | Concentration |
|---|---|
| Chromium chloride hexahydrate | 100 g/l |
| Sodium formate (50% soln.) | 60 ml/l |
| Sodium formaldehyde bisulfite | 4–6 g/l |
| Ammonium chloride | 90 g/l |
| Potassium chloride | 75 g/l |
| Surfactant* | 0.2 g/l |
| Boric acid | 40 g/l |

Zonyl A

The bath is mechanically agitated by stirring and operates at a pH ranging from 2.5 to 3.5 at a temperature of about 20° C. to about 25° C. At a current density of 100 ASF, the bath produces about an 80 mm plating coverage on a Hull cell panel. The plating bath operates satisfactorily when the surfactant concentration is varied within a range of from 20 up to 600 mg/l.

EXAMPLE 8

An aqueous acidic trivalent chromium electroplating solution is prepared employing the constituents in the concentrations as follows:

| Constituent | Concentration |
|---|---|
| Chromium chloride hexahydrate | 100 g/l |
| Potassium formate (50% soln.) | 70 ml/l |
| Sodium formaldehyde bisulfite | 4–6 g/l |
| Ammonium chloride | 90 g/l |
| Potassium chloride | 75 g/l |
| Surfactant* | 0.2 g/l |
| Boric acid | 40 g/l |

*Zonyl A

The bath is mechanically agitated by stirring and operates at a pH ranging from 2.5 to 3.5 at a temperature of about 20° C. to about 25° C. At a current density of 100 ASF, the bath produces about an 80 mm plating coverage on a Hull cell panel. The plating bath operates satisfactorily when the surfactant concentration is varied within a range of from 20 up to 600 mg/l.

EXAMPLE 9

An aqueous acidic trivalent chromium electroplating solution is prepared employing the constituents in the concentrations as follows:

| Constituent | Concentration |
|---|---|
| Chromium chloride hexahydrate | 100 g/l |
| Ammonium formate (50% soln.) | 80 ml/l |
| Sodium formaldehyde bisulfite | 4–6 g/l |

-continued

| Constituent | Concentration |
|---|---|
| Ammonium chloride | 90 g/l |
| Potassium chloride | 75 g/l |
| Surfactant* | 0.2 g/l |
| Boric acid | 40 g/l |

*Emphos

The bath is mechanically agitated by stirring and operates at a pH ranging from 2.5 to 3.5 at a temperature of about 20° C. to about 25° C. At a current density of 100 ASF, the bath produces about an 80 mm plating coverage on a Hull cell panel. The plating bath operates satisfactorily when the surfactant concentration is varied within a range of from 20 up to 600 mg/l.

EXAMPLE 10

An aqueous acidic trivalent chromium electroplating solution is prepared employing the constituents in the concentrations as follows:

| Constituent | Concentration |
|---|---|
| Chromium chloride hexahydrate | 100 g/l |
| Sodium formate (50% soln.) | 60 ml/l |
| Sodium formaldehyde bisulfite | 4–6 g/l |
| Ammonium chloride | 90 g/l |
| Potassium chloride | 75 g/l |
| Surfactant* | 0.2 g/l |
| Boric acid | 40 g/l |

*Emphos

The bath is mechanically agitated by stirring and operates at a pH ranging from 2.5 to 3.5 at a temperature of about 20° C. to about 25° C. At a current density of 100 ASF, the bath produces about an 80 mm plating coverage on a Hull cell panel. The plating bath operates satisfactorily when the surfactant concentration is varied within a range of from 20 up to 600 mg/l.

EXAMPLE 11

An aqueous acidic trivalent chromium electroplating solution is prepared employing the constituents in the concentrations as follows:

| Constituent | Concentration |
|---|---|
| Chromium chloride hexahydrate | 100 g/l |
| Potassium formate (50% soln.) | 70 ml/l |
| Sodium formaldehyde bisulfite | 4–6 g/l |
| Ammonium chloride | 90 g/l |
| Potassium chloride | 75 g/l |
| Surfactant* | 0.2 g/l |
| Boric acid | 40 g/l |

*Emphos

The bath is mechanically agitated by stirring and operates at a pH ranging from 2.5 to 3.5 at a temperature of about 20° C. to about 25° C. At a current density of 100 ASF, the bath produces about an 80 mm plating coverage on a Hull cell panel. The plating bath operates satisfactorily when the surfactant concentration is varied within a range of from 20 up to 600 mg/l.

While it will be apparent that the invention herein disclosed is calculated to achieve the benefits and advantages as hereinabove set forth, it will be appreciated that the invention is susceptible to modification, variation and change without departing from the spirit thereof on the scope of the subjoined claims.

What is claimed is:

1. An aqueous acidic trivalent chromium electroplating solution containing about 0.2 to about 0.6 molar trivalent chromium, a chromium complexing agent in an amount effective to complex chromium in said bath, a reducing agent for hexavalent chromium in an amount sufficient to prevent hexavalent.chromium build-up to levels detrimental to the plating deposit, a mono-, di- or tri-ester phosphate anionic or non-ionic surface active agent selected from the class corresponding to the following structural formula:

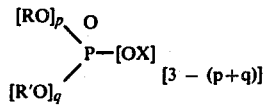

Wherein:

R'=an alkyl group of 8 carbons;

X=H, Na or K;

p=1 or 2;

q=0 or 1;

(p+q)=2 or 3;

R=R''—$(OCH_2CH_2)$—$_n$ in which;

R''=R'''—aryl, an alkyl group having 1 to 10 carbons, or H;

R'''=an alkyl group having 1 to 10 carbons or H; and n=0–12 which surface active agent is present in amount sufficient to improve the efficiency of the electroplating bath and enhance the uniformity of the chromium deposit.

2. The solution as defined in claim 1 in which said surface active agent is present in an amount of about 0.02 g/l to about 1.5 g/l.

3. The solution as defined in claim 1 in which said surface active agent is present in an amount of about 0.05 g/l to about 0.2 g/l.

4. The solution as defined in claim 1 in which said complexing agent comprises formate present in an amount to provide a ratio of formate to trivalent chromium of about 1:1 to about 3:1.

5. The solution as defined in claim 1 in which said reducing agent is present in an amount sufficient to maintain the concentration of any hexavalent chromium present at a level below about 6 ppm.

6. The solution as defined in claim 1 further including conductivity salts present in an amount up to about 300 g/l.

7. The solution as defined in claim 1 having a hydrogen ion concentration to provide a pH of about 2.5 to about 4.0.

8. The solution as defined in claim 1 having a hydrogen ion concentration to provide a pH of about 2.8 to about 3.4.

9. The solution as defined in claim 1 further including a buffering agent.

10. The solution as defined in claim 9 in which said buffering agent is selected from the group consisting of boric acid, borate salts and mixtures thereof.

11. The solution as defined in claim 10 in which said buffering agent is present in an amount of about 0.5 to about 1.0 molar.

12. A process for electroplating chromium on a cathode which comprises the steps of immersing a cathode to be electroplated in an aqueous acidic trivalent chromium electroplating solution as defined in claim 1, maintaining said solution at a pH of about 2.5 to about 4.0 and at a temperature of about 15° C. to about 35° C., applying an electrical current between an anode and said cathode to provide a current density of about 50 to about 250 ASF for a period of time to electrodeposit the desired thickness of chromium on said cathode.

* * * * *